United States Patent [19]

Roth et al.

[11] Patent Number: 4,745,252

[45] Date of Patent: May 17, 1988

[54] DEVICE FOR THE HOMOGENIZATION OF THE TEMPERATURE OF PASSING METALLIC PRODUCTS

[75] Inventors: Jean-Luc Roth; Hervé Sierpinski, both of Metz, France

[73] Assignee: IRSID, Maizieres-les-Metz, France

[21] Appl. No.: 914,530

[22] Filed: Oct. 3, 1986

Related U.S. Application Data

[63] Continuation of Ser. No. 758,999, Jul. 25, 1985, abandoned.

[30] Foreign Application Priority Data

Jul. 27, 1984 [FR] France ..... 84 12228

[51] Int. Cl.[4] ..... H05B 6/40

[52] U.S. Cl. ..... 219/10.71; 219/10.75; 219/10.79; 219/7.5

[58] Field of Search ..... 219/10.71, 10.69, 10.75, 219/10.49 K, 10.61 K, 10.79, 10.57, 10.41, 10.43, 10.67, 7.5

[56] References Cited

U.S. PATENT DOCUMENTS 3,469,052 9/1967 Hatchard ..... 219/10.71 X
3,471,673 10/1969 Frostick ..... 219/10.71 X
3,715,556 2/1973 Balzer et al. ..... 219/10.57 X
4,289,944 9/1981 Reese ..... 219/10.71 X
4,469,925 9/1984 Toshiro et al. ..... 219/10.49 R

FOREIGN PATENT DOCUMENTS 2372402 6/1978 France .

*Primary Examiner*—Philip H. Leung
*Attorney, Agent, or Firm*—Pollock, Vande Sande & Priddy

[57] ABSTRACT

Device for temperature homogenization of passing metallic products (3), housed in the bed plate of the temperature equalization zone of a reheating furnace and constituted by elongated polyphase static sliding field inductors (14) located in the extension of elements (9) supporting the metallic products in the heating zone (7) of the furnace. The device achieves efficient and rapid heating by enabling precise localization of the heating zone in a predetermined part of the metallic product to be treated, and is particularly useful for treating large dimension products, such as large slabs, in order to attenuate or eliminate skid marks (20) which are usually present upon their emergence from prior art reheating furnaces.

6 Claims, 2 Drawing Sheets x x'

DEVICE FOR THE HOMOGENIZATION OF THE TEMPERATURE OF PASSING METALLIC PRODUCTS

This application is a continuation, of application Ser. No. 758,999, filed July 25, 1985, now abandoned.

FIELD OF THE INVENTION

The present invention relates to temperature homogenization of passing metallic products, especially steel slabs to be rolled and previously subjected for this purpose to reheating which was not entirely homogeneous.

BACKGROUND OF THE INVENTION

Before rolling, it is first necessary to bring the metallic products to a sufficiently high temperature, and secondly, it is desirable for this temperature to be as uniform as possible throughout the mass of such products. The second objective is especially difficult to achieve in the case of large size products such as slabs.

In conventional industrial flame furnaces, intended for reheating slabs prior to rolling, whether these are pusher (slabs joined) or walking beams (slabs separated) type furnaces, the slabs move on a bed plate constituted by support elements arranged parallel to the direction of movement of the slabs. These support elements may be constituted solely by fixed slides (in pusher type furnaces) or by one group of fixed bars and another group of movable beams, the latter assuring the displacement of the slabs to the interior of the furnace (in walking beams type furnaces). At the region of contact between a slab and the support elements, there are usually regions which are colder than the slab as a whole, and these can sometimes spread through the entire thickness of the product. These colder regions are superficially recognizable by a coloration darker than the rest of the product, and for this reason they are generally referred to as "skid marks." Such a phenomenon arises particularly in furnaces intended for reheating thick products where heating takes place not only from the vault but also from the bottom of the furnace, beneath the products, because, in the first place, the support elements must be cooled interiorly and, in the second place, the area of contact between the slabs and the support elements is not directly exposed to the heat, which is transmitted for the most part by radiation.

The presence of these skid marks is the cause of local temperature gradients sufficiently great to cause metallurgical defects in the product, and leads to extra thickness during final rolling.

It has been attempted to diminish such defects by acting, at the level of the rolling mill, on the water jets intended for the removal of calamine from the products in passage. The cooling effect resulting from this can be adapted for the purpose of reducing skid marks, e.g., by cooling the product with the exception of these coldest regions. However, it was soon recognized that this method, which is inconvenient to carry out, produces the desired results only with difficulty, and it is therefore seldom used.

Another solution consists of causing the reheated products to remain in the non-heated terminal area of the furnace (the thermal equalization zone), so as to allow a better temperature distribution in the entire product mass. However, this process is quite slow, and homogenization is achieved only at the cost of lowered productivity or of increased size of the installation, and requires considerable added energy expenditure.

A further solution, which has not yet, to applicant's knowledge, been used industrially, consists of placing in the rolling conveyor at the furnace outlet one or more magnetic sliding field inductors for local heating of the slabs at the locations of the skid marks (see French Patent No. 76 35635). However, this inductive heating solution, while in itself rather neat, is based on discontinuous operation of the inductors, and hence requires a system of detecting the skid marks, and interruption of the movement of the slabs when the skid marks are located above the inductors.

OBJECT OF THE INVENTION

It is an object of the present invention to provide a solution which assures, throughout the reheated product, a temperature which is homogeneous and sufficient for the rolling operation, while avoiding the drawbacks of the above-mentioned prior art solutions.

For this purpose, an object of the invention is a device for the temperature homogenization of metallic products in passage, especially steel slabs to be rolled and previously raised in temperature in the heating zone of a reheating furnace, with a thermal equalization zone downstream of this heating zone. The device is constituted by a plurality of elongated polyphase static sliding field inductors located in the thermal equalization zone of the reheating furnace, parallel to each other, and in the extension of the elements for supporting the products passing through the heating zone. The active side of these inductors, turned toward the products, has a width at least equal to that of the support elements, preferably between one and four times that width, and most preferably equal to about three times that width.

In accordance with a variant, the conductors with which the inductors are equipped are oriented perpendicularly to the direction of movement of the products.

As will be understood, the present invention preconizes selective inductive heating, situated in the temperature equalization zone of the reheating furnace, and localized under the predetermined parts of the metallic product which constitute the skid marks.

The positioning as well as the nature of the heating means selected render the device according to the invention an efficient heating means which advantageously completes the heating which takes place in the heating zone itself.

In effect, the localization of the inductors in the extension of the support slides for the metallic products guarantees their permanent availability with respect to the skid marks to be eliminated.

Moreover, the choice of elongated polyphase static sliding field inductors is especially appropriate since these make it possible to generate locally significant induced currents, and therefore a calorific contribution concentrated and localized at the regions of the product to be heated.

In addition, the thermal map of a skid mark is generally in the form of a family of relatively deep sinuosoidal isotherms in the thickness of the metal. The spatial separation of the power induced in the product by a sliding field inductor tends precisely to correspond to the shape of such a thermal profile.

Because of this, it was possible to determine that, under the usual conditions of furnace operation, the width of the active side of the inductors is preferably in a ratio of about 3:1 with the width of the support elements. Beyond a ratio of 4:1, a significant portion of the induced power is uselessly injected at the periphery of the skid mark, whereas beyond a ratio of 1:1, the inductor is too small to meet the needs for eliminating skid marks.

Furthermore, the invention has a decisive economic basis. Nowadays, market demand is oriented toward metallic products having particular mechanical characteristics, especially resilience and adaptability to welding. This means that the grain in the metal must be very precisely controlled. One of the means for obtaining such characteristics consists of so-called "low temperature" reheating, i.e., drawing the metallic products from the furnace at about 950° C. (instead of the usual 1100° to 1200° C.). Of course, this process, while being fuel efficient, requires precise control of the reheating of the product. The device according to the invention, which guarantees homogeneous heating at the core of the metal, makes it possible to consider the feasibility of such "low temperature" reheating.

BRIEF DESCRIPTION OF THE DRAWINGS

In order that the invention may be more clearly understood, it will now be described with reference to the accompanying drawings, in which several embodiments of the invention are shown for purposes of illustration, and in which.

DETAILED DESCRIPTION

Figure 1:
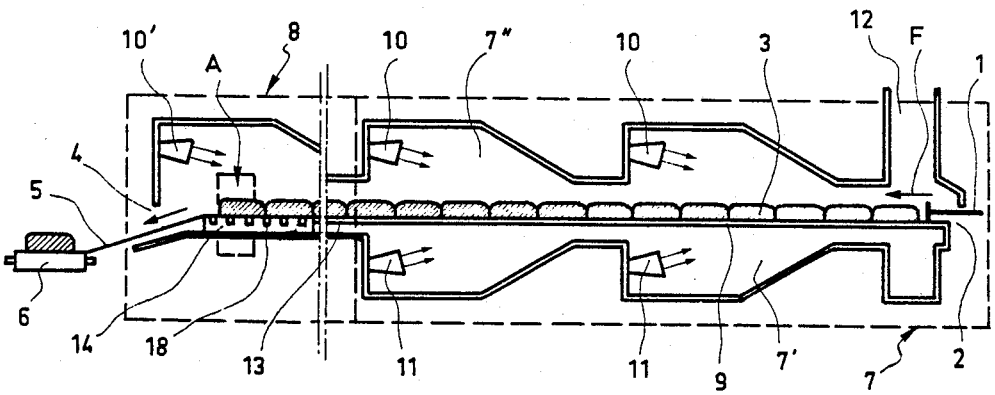
FIG. 1 shows a schematic longitudinal cross section of a pusher type furnace for reheating steel slabs, equipped with the device according to the invention.

In the pusher type furnace shown in FIG. 1, slabs 3 are juxtaposed by their small lateral sides so as to form a continuous sheet which moves from right to left, in the direction indicated by arrow F, with the assistance of a pusher 1 at the inlet 2 of the furnace. The slabs thus pass slowly in a straight line through the furnace from inlet 2 to outlet 4, where they are discharged one by one onto an inclined plane 5 which deposits them on a rolling conveyor 6 for the purpose of conducting them to the rolling mill (not shown).

The furnace comprises two thermal zones, namely, a first zone 7 called "heating zone," about 18 meters long, in the upstream portion of the furnace, and a second zone 8 called "equalization zone," about 12 meters long, in the downstream portion of the furnace.

The heating zone conventionally comprises a first enclosure 7', for preheating cold products, followed by a second enclosure 7'' for heating the preheated products to their nominal temperature.

In the heating zone, slabs 3 are placed on a wearing strip of metallic slides 9 interiorly cooled by circulation of water. These slides 9, 20 cm wide and spaced from one another by a distance of the order of 1.5 meters, form a parallel network oriented in the displacement direction of slabs 3. The heating zone also comprises frontal burners 10 and 11, respectively located in the upper and lower parts of the furnace.

The equalization zone 8 can also be equipped with frontal burners 10', but only for the purpose of compensating for heat losses through the furnace walls.

The fumes produced in the furnace circulate in a direction opposite to the movement of slabs 3 to the vicinity of the furnace door where they are evacuated through a chimney 12.

As already stated, the contact between slab and slide impedes at this location the rapid rise in the temperature of slab 3, and brings about the formation of cold marks or skid marks.

In the equalization (or temperture homogenization) zone 8, slabs 3 are placed on a filled hearth 13 of refractory material. The latter, according to the invention, is equipped with elongated sliding magnetic field inductors 14. These inductors are placed in the extension of slides 9 on the basis of one inductor per slide, and extend, in the example under consideration, over the entire length of equalization zone 8. In this example, the active side 15 of the inductors facing hearth 13 has a length of 6 meters and a width of about 50 cm.

Figure 2:
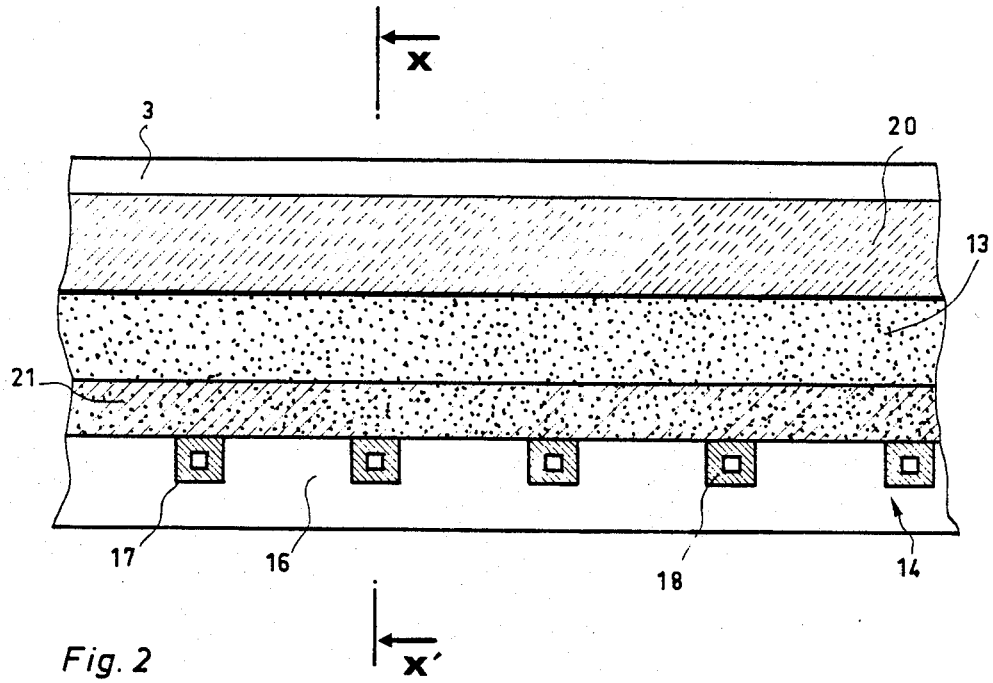
FIG. 2 is an enlargement of portion A of the furnace illustrated in FIG. 1.
Figure 3:
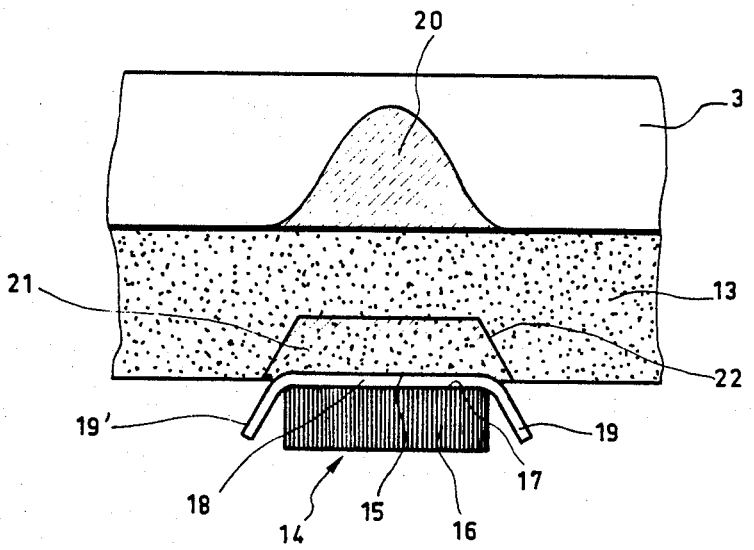
FIG. 3 is a transverse section view along line X—X' of FIG. 2.

FIGS. 2 and 3 show the provision in equalization hearth 13 for placement of a sliding field inductor 14. It can be seen that inductor 14 has a plane structure and comprises a magnetic foliated core 16 having on its active side 15 regularly spaced parallel slots 17 for housing conductors 18, formed of rectangular bars of hollow copper to permit internal circulation of a cooling fluid. Spool heads 19 and 19' pass laterally from the magnetic core and bend downwardly in order to reduce their required space under hearth 13.

The conductors are connected in a manner sufficient for triphase electrical supply of industrial frequency (not shown) so as to produce a sliding movable magnetic field along the longitudinal axis of the inductor.

According to the invention, inductors 14 are placed under hearth 13 in an extension of slides 9. In this way, skid marks 20 locally generated in slabs 3 upon contact with these slides pass above the inductors in the course of the progression of the slabs through the thermal equalization zone 8.

In the described example, an insert 21 of the refractory material having high thermal insulating properties, e.g., an alumina base fireproof refractory material, has been lodged in a recess 22 provided for this purpose on the lower face of hearth 13 above inductor 14. This insert acts to reinforce the thermal protection of inductor 14 with respect to the heat given off by slab 3.

Moreover, in order to increase the heat yield of inductor 14, it is desirable to bring it closer to slab 3, to a distance less than the thickness of hearth 13, in order to reduce the clearance (the distance separating the active face 15 of the inductor from slab 3). FIG. 3 shows that this result can be easily attained by use of an insert 21 having a concave base, serving as a mold for inductor 14.

The action of inductors 14 can be regulated in a conventional manner, e.g., by acting on the intensity of the exciter current, or on its frequency.

Experience has shown that, in the case of the furnace described above, in order to eliminate entirely the skid marks in slabs 250 mm thick, 3.5 meters long and 2 meters wide, reheated to 950° C., it is desirable to use, with a current having a frequency of 50 Hz, an electrical power of 58 kW for each inductor when the production of the furnace is 85 tons per hour.

If the production is 160 tons per hour, a power of 220 kW by inductor should be used.

It goes without saying that the invention is not limited to the just described embodiment. For example, one desirable variant consists of providing a curved active face on the inductor. This makes it possible to increase the induced power at the center and to reduce it at the two edges, because of the variation thus obtained of the clearance along the width of the active face 15. This arrangement may be advantageous to the extent that the spatial distribution of the induced power of heating in the slab thus tends to come still closer to the sinusoidal thermal profile of the skid mark 20.

Other variants of the inductor structure can be devised to create a curved active face, such as a semi-cylindrical or a circular sector structure.

The direction of sliding of the magnetic field can also be modified according to the orientation of the conductor bars. In the above-described examples, a transverse arrangement (i.e., perpendicular to the direction of movement of slabs 3) has been used, but it is possible to choose a longitudinal arrangement (i.e., parallel to the direction of movement of slabs 3), so as to obtain a field which slides according to a direction perpendicular to that in which the slabs are moving.

Figure 4:
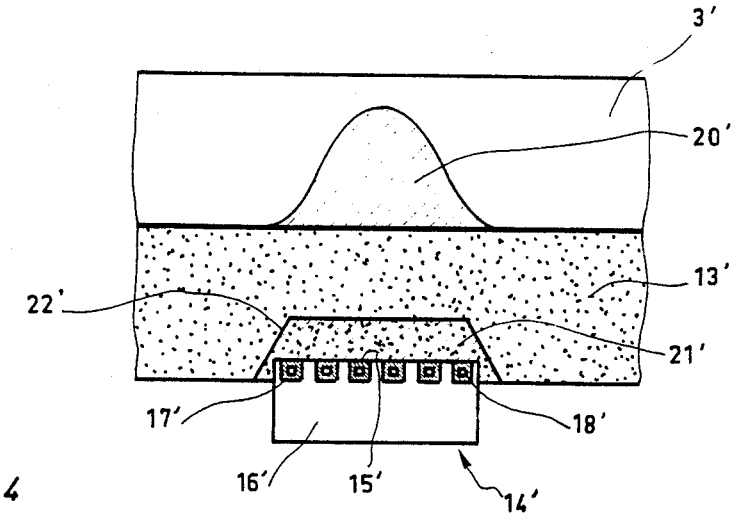
FIG. 4 shows a variant of the invention in a view similar to that of FIG. 3.

Such a variant is illustated in FIG. 4. The essential difference between this and the preceding alternatives resides in the fact that the conductor bars 18' are located in longitudinal slots 17' this time parallel to the direction of movement of slabs 3, and that magnetic core 16' of inductor 14' is foliated along planes parallel to the plane of the figure.

Further, as regards the arrangement of the inductors in their furnace equalization hearth, other arrangements are also possible. In particular, the inductors could be distributed to different locations in the equalization hearth, each inductor of course being located in the extension of the slides.

It will be understood that, the greater the length of the inductors, the less important is the surface heating power of each inductor. As a limit, the inductors could extend over the entire length of the equalization hearth.

What is claimed is:

1. In a reheating furnace comprising a heating zone provided with burners, metallic products to be rolled moving in said reheating furnace and, downstream of said heating zone with respect to the direction of movement of products, a thermal equalization zone, said furnace having, in said heating zone, support means comprising elongated support elements on which said products are moving, said support elements being constituted by slides or bars arranged parallel to the direction of the movement of the products, the improvement comprising an apparatus for homogenizing the temperature of said metallic products, said apparatus comprising elongated static polyphase inductors located, in said thermal equalization zone, in the prolongation of said support elements extending into said thermal equalization zone, and hence directly beneath skid marks in the lower portions of said metallic products resulting from contact between said metallic products and said support elements preventing their direct exposure to heat in said heating zone, an active face of said inductors facing said metallic products and having a width in the range of one to four times the width of said support elements, whereby heating of said metallic products is concentrated in the region of said skid marks.

2. Apparatus according to claim 1, wherein said active face (15) has a width about three times the width of said support means (9).

3. Apparatus according to claim 1, wherein said inductors (14) comprise conductors (18) oriented perpendicularly to the direction of movement of said products (3).

4. Apparatus according to claim 1, wherein said active face (15) of said inductors (14) is flat.

5. Apparatus according to claim 1, wherein said active face (15) of said inductors (14) is curved.

6. Apparatus according to claim 1, wherein said active face (15) of said inductors (14) is covered by a good heat insulating refractory material, said material forming an insert (21) in a lower face of a hearth (13) of said thermal equalization zone.

* * * * *